US006996949B1

(12) United States Patent
Bergerioux et al.

(10) Patent No.: US 6,996,949 B1
(45) Date of Patent: Feb. 14, 2006

(54) PACKING CONTAINER AND METHOD OF MANUFACTURING THE CONTAINERS

(75) Inventors: Claude Bergerioux, Gotenba (JP); Yasuyuki Moriyama, Chiba (JP)

(73) Assignee: Tetra Laval Holdings & Finance S.A., (CH)

( * ) Notice: Subject to any disclaimer, the term of this patent is extended or adjusted under 35 U.S.C. 154(b) by 0 days.

(21) Appl. No.: 09/913,276

(22) PCT Filed: Feb. 16, 2000

(86) PCT No.: PCT/JP00/00845

§ 371 (c)(1),
(2), (4) Date: Dec. 3, 2001

(87) PCT Pub. No.: WO00/48914

PCT Pub. Date: Aug. 24, 2000

(30) Foreign Application Priority Data

Feb. 17, 1999 (JP) ..... 11-038741
Nov. 2, 1999 (JP) ..... 11-312529

(51) Int. Cl.
*B65B 61/18* (2006.01)

(52) U.S. Cl. ..... 53/412; 53/420; 53/416; 53/452; 53/133.2; 53/133.5; 53/133.7; 53/470; 493/86; 493/87; 493/962

(58) Field of Classification Search ..... 53/412, 53/420, 416, 133.2, 133.7, 133.5, 452, 471, 53/470; 493/87, 962, 86
See application file for complete search history.

(56) References Cited

U.S. PATENT DOCUMENTS

| | | | | | |
|---|---|---|---|---|---|
| 3,219,240 | A | * | 11/1965 | Campbell, Jr. | 222/183 |
| 4,815,655 | A | * | 3/1989 | Jacobsson et al. | 229/123.2 |
| 4,819,839 | A | * | 4/1989 | Carlsson et al. | 222/541.9 |
| RE33,893 | E | * | 4/1992 | Elias et al. | 229/123.3 |
| 5,135,462 | A | * | 8/1992 | Stahlecker et al. | 493/87 |
| 5,219,320 | A | * | 6/1993 | Abrams et al. | 493/8 |
| 5,335,478 | A | * | 8/1994 | Aronsen | 53/412 |
| 5,495,706 | A | * | 3/1996 | Bjorck et al. | 53/412 |
| 5,653,383 | A | * | 8/1997 | Adachi et al. | 229/125.15 |
| 5,875,958 | A | * | 3/1999 | Weiteder et al. | 229/125.15 |
| 5,875,959 | A | * | 3/1999 | Weiteder et al. | 229/125.15 |
| 6,007,466 | A | * | 12/1999 | Bouraoui et al. | 493/87 |
| 6,375,067 | B1 | * | 4/2002 | Moriyama | 229/125.09 |
| 6,378,271 | B1 | * | 4/2002 | Skinner et al. | 53/410 |

FOREIGN PATENT DOCUMENTS

| | | | |
|---|---|---|---|
| EP | 0 165 639 | | 6/1985 |
| JP | 6-46825 | * | 3/1990 |
| JP | 7-16595 | * | 8/1991 |
| JP | 6-143460 | * | 5/1994 |
| JP | 6-218850 | * | 8/1994 |

* cited by examiner

*Primary Examiner*—John Sipos
*Assistant Examiner*—Michelle Lopez
(74) *Attorney, Agent, or Firm*—Lorusso & Loud

(57) ABSTRACT

The packaging container includes a container body formed from a packaging material, and a cap unit attached to a top wall of the container body. The cap unit includes a lip, a pull tab which covers a discharge opening and an inner tape which covers the discharge opening portion from a reverse side of the packaging material. Since the cap is attached to the packaging material in advance of forming the container, positioning of the container body is not required for cap attachment.

5 Claims, 18 Drawing Sheets

PACKING CONTAINER AND METHOD OF MANUFACTURING THE CONTAINERS

CROSS-REFERENCE TO RELATED APPLICATIONS

This application is a National Phase Application (35 USC 371) of PCT/JP00/00845 and claims priority of Japanese Application No. 11-38741 filed Feb. 17, 1999 and Japanese Application No. 11-312529 filed Nov. 2, 1999.

TECHNICAL FIELD

The present invention relates to a packaging container and to a method of manufacturing the same.

BACKGROUND ART

Conventionally, liquid food such as milk or soft drink is sold in a form such that the liquid food is contained in a brick-shaped or polyhedral packaging container formed of a packaging material. In order to enable portionwise discharge of liquid food, there is provided a cap-type packaging container whose container body has a cap that can be opened and closed freely.

In this case, a packaging container manufacturing apparatus is designed to include a charging machine and a cap applicator. In the charging machine, a packaging material is formed into a container body, and a liquid food is charged into the container body. Subsequently, the container body is transported to the cap applicator by means of a conveyer. At the cap applicator, a cap is attached to the container body by any of various application methods, such as a hot melt method, a heat sealing method, or an ultrasonic sealing method.

Meanwhile, in the case of a pull-tab-type packaging container which contains liquid food in such an amount that a person can drink the food as a single serving, a discharge opening is formed in a top wall and is covered with a pull tab.

FIG. 1 is a perspective view of a conventional pull-tab-type packaging container.

In FIG. 1, reference numeral 210 denotes a container body for accommodating a liquid food; 212 denotes a top wall of the container body 210; 219 denotes a rear wall of the container body 210; and 220 denotes a side wall of the container body 210. A discharge opening 221 in the form of a punched hole is formed in a discharge opening portion defined at a predetermined position on the top wall 212, and the discharge opening 221 is covered with a pull tab 215. In this case, a person who wishes to drink the liquid food; i.e., a drinker, peels the pull tab 215 off the container body 210; removes a straw 218 from a straw package 216 bonded to the rear wall 219; and inserts the straw 218 into the discharge opening 221 in order to drink the liquid food. Alternatively, the drinker can drink the liquid food directly from the opened discharge opening 221 while placing his/her lips on the discharge opening 221.

The pull tab 215 has a horizontal portion 223 and a vertical portion 224. The horizontal portion 223 has an area greater than that of the discharge opening 221, and upon attachment to the packaging material 211 the horizontal portion 223 extends along the top wall 212 and covers the vicinity of the discharge opening 221 to thereby prevent the vicinity from being dirtied. The vertical portion 224 extends along the side wall 220 and serves as a tab used for peeling off the pull tab 215.

However, in the case of the conventional cap-type packaging container, since a cap is attached to a container body transported by means of a conveyer, the container body must be properly positioned in order to enable accurate attachment of the cap onto the container body at a predetermined position.

Accordingly, the container body must be stopped on the conveyer, or the container body must be temporarily removed from the conveyer and returned onto the conveyer after attachment of the cap. Therefore, the position at which the cap is attached varies, resulting in a decrease in quality of the packaging container. Any attempt to eliminate such variation in the cap attachment position makes the structure of the packaging container manufacturing apparatus complicated and increases the cost of the packaging container manufacturing apparatus.

The pull-tab-type packaging container has a drawback in that when a drinker places his/her lips on the discharge opening 221 in an opened state to thereby drink liquid food directly from the discharge opening 221, the drinker receives an unpleasant sensation from portions around the discharge opening 221.

An object of the present invention is to solve the problems involved in the above-described conventional cap-type packaging container and to provide a packaging container which is of improved quality and can simplify the structure of a packaging container manufacturing apparatus while reducing the cost thereof, as well as a method of manufacturing the packaging container.

Another object of the present invention is to solve the problems involved in the above-described conventional pull-tab-type packaging container and to provide a packaging container which provides a drinker with a pleasant sensation upon placement of his/her lips on portions around a discharge opening, as well as a method of manufacturing the packaging container.

DISCLOSURE OF THE INVENTION

In order to achieve the above object, a packaging container according to the present invention comprises a container body formed from a packaging material, and a cap unit attached to a cap attachment portion of a top wall of the container body.

The cap unit includes a collar portion, a pull tab, an inner tape, and a lid portion. The pull tab covers, from an outer side of the packaging material, a discharge opening portion defined on the packaging material to correspond to the cap attachment portion. The inner tape covers the discharge opening portion from a reverse side of the packaging material. The lid portion is fitted into the collar portion via the pull tab.

In this case, since the cap is attached to the packaging material in advance, the cap is not required to be attached to the container body after the container body is positioned.

Therefore, there is eliminated the necessity of stopping the container body on the conveyer or temporarily removing the container body from the conveyer and returning it onto the conveyer after attachment of the cap. Accordingly, variation in the position at which the cap is attached is prevented, so that the quality of the packaging container can be improved. In addition, the structure of the packaging container manufacturing apparatus can be simplified, and the cost of the packaging container manufacturing apparatus can be lowered.

In another packaging container according to the present invention, a punched hole is formed in the discharge opening portion.

In still another packaging container according to the present invention, a thin wall portion is formed in the discharge opening portion.

In this case, since the punched hole is not formed in the packaging material immediately before the liquid food is charged, generation of pin holes in the packaging material can be suppressed.

Still another packaging container according to the present invention comprises a container body formed from a packaging material, and a cap unit attached to a cap attachment portion of a top wall of the container body.

The cap unit includes a pull tab, an inner tape, and a lip. The pull tab covers, from an outer side of the packaging material, a discharge opening portion defined on the packaging material to correspond to the cap attachment portion. The inner tape covers the discharge opening portion from a reverse side of the packaging material. The lip partially surrounds the discharge opening portion and is welded to the top wall via the pull tab.

Still another packaging container according to the present invention comprises a container body, a lip, and a pull tab. The lip is fixed to a top wall of the container body and has a thick portion which partially surrounds a discharge opening portion and which does not have a lid. The pull tab is bonded to a portion of the packaging material forming the top wall such that the pull tab covers the discharge opening portion from an outer side of the packaging material.

In this case, since the thick portion is present around the discharge opening portion, the drinker obtains a pleasant sensation upon placement of his/her lips on portions around the discharge opening portion. In addition, drinking the liquid food is easy, and does not require use of a straw.

Further, since the thick portion is formed integrally with the lip, the process of fabricating the packaging container can be simplified.

Still another packaging container according to the present invention comprises an inner tape which is bonded to the packaging material from a reverse side thereof.

In still another packaging container according to the present invention, the lip includes an outer patch seal, and the thick portion is formed on the outer patch seal through injection molding.

In still another packaging container according to the present invention, the outer patch seal has a body portion bonded to the top wall and a skirt portion bonded to the front wall.

In still another packaging container according to the present invention, the thick portion of the lip is formed through thermal deformation of a film.

A method of manufacturing a packaging container according to the present invention comprises a cap attachment step of attaching a cap onto a cap attachment portion of a packaging material before being subjected to forming; a forming step of forming the packaging material, on which the cap has been attached, into a predetermined shape; and a charging step of charging a liquid food into the formed packaging material.

In this case, since the cap is attached to the packaging material in advance, the cap is not required to be attached to the container body after the container body is positioned.

Therefore, there is eliminated the necessity of stopping the container body on the conveyer or temporarily removing the container body from the conveyer and returning it onto the conveyer after attachment of the cap. Accordingly, variation in the position at which the cap is attached is prevented, so that the quality of the packaging container can be improved. In addition, the structure of the packaging container manufacturing apparatus can be simplified, and the cost of the packaging container manufacturing apparatus can be lowered.

In another method of manufacturing a packaging container according to the present invention, the packaging material has a web-like shape before being subjected to forming; and the packaging material on which the cap has been attached is formed into a tubular shape.

In still another method of manufacturing a packaging container according to the present invention, the cap has a collar portion and a lid portion and can be brought into an opened state and a closed state.

In this case, the cap attachment step includes the steps of: fixing the cap onto the packaging material; bringing the cap into an opened state; punching a hole in the packaging material; welding an inner tape onto a reverse surface of the packaging material and a pull tab onto an outer surface of the packaging material in order to cover an area surrounded by the collar portion; welding together the inner tape and the pull tab to thereby form a rupture portion; and fitting the lid portion into the collar portion.

In this case, since the punched hole is not formed in the packaging material immediately before the liquid food is charged, generation of pin holes in the packaging material can be suppressed.

In still another method of manufacturing a packaging container according to the present invention, the cap has a collar portion.

In this case, the cap attachment step includes the steps of: punching a hole in the packaging material; welding an inner tape onto a reverse surface of the packaging material and a pull tab onto an outer surface of the packaging material in order to cover an area surrounded by the collar portion; and welding together the inner tape and the pull tab to thereby form a rupture portion.

In still another method of manufacturing a packaging container according to the present invention, a thin wall portion is formed in advance in the packaging material before the packaging material is subjected to forming. The cap has a collar portion and a lid portion and can be brought into an opened state and a closed state.

In this case, the cap attachment step includes the steps of: fixing the cap onto the packaging material such that the cap faces the thin wall portion; bringing the cap into an opened state; welding a pull tab onto an outer surface of the packaging material in order to cover an area surrounded by the collar portion; and fitting the lid portion into the collar portion.

In still another method of manufacturing a packaging container according to the present invention, a thin wall portion is formed in advance in the packaging material before the packaging material is subjected to forming. The cap has a collar portion.

In this case, the cap attachment step includes the steps of: fixing the cap onto the packaging material such that the cap faces the thin wall portion; and welding a pull tab onto an outer surface of the packaging material in order to cover an area surrounded by the collar portion.

In still another method of manufacturing a packaging container according to the present invention, the cap has a lip.

In this case, the cap attachment step includes the steps of: punching a hole in the packaging material; welding an inner tape onto a reverse surface of the packaging material and a lip onto an outer surface of the packaging material via a pull tab and at the same time welding together the inner tape and the pull tab to thereby form a rupture portion.

Still another method of manufacturing a packaging container according to the present invention comprises the steps of fixing a lip onto a packaging material; forming a discharge opening portion in at least the lip; and bonding a pull tab to the outer surface of the packaging material in order to cover the discharge opening portion.

In still another method of manufacturing a packaging container according to the present invention, an inner tape is bonded to the reverse surface of the packaging material.

BEST MODE FOR CARRYING OUT THE INVENTION

The embodiments of the present invention will next be described in detail with reference to the drawings.

Figure 1:
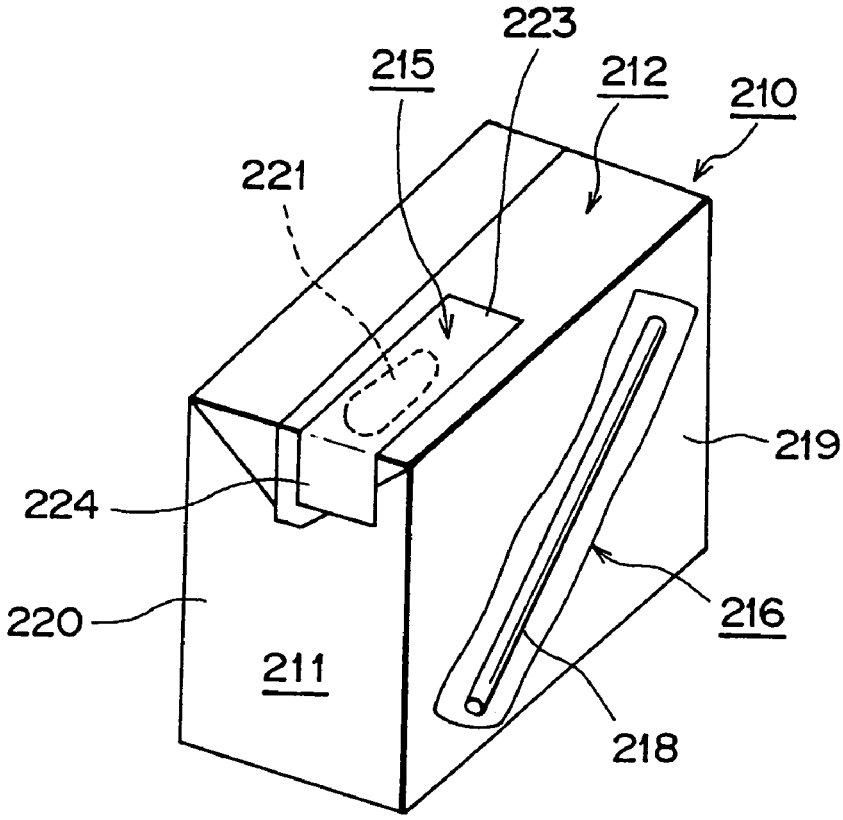
FIG. 1 (PRIOR ART)
FIG. 1 is a perspective view of a conventional pull-tab-type packaging container.
Figure 2:
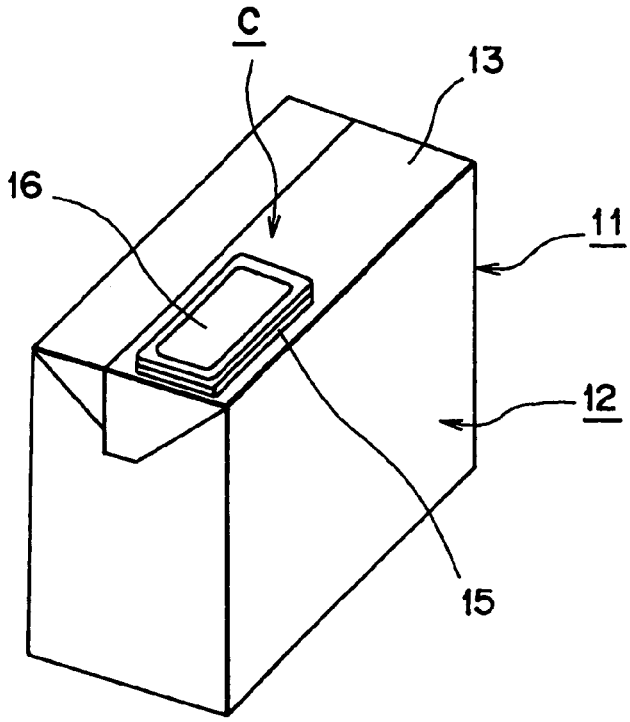
FIG. 2 is a perspective view of a packaging container according to a first embodiment of the present invention.

FIG. 2 is a perspective view of a packaging container according to a first embodiment of the present invention.

In FIG. 2, reference numeral 11 denotes a packaging container which comprises a container body 12 formed from a packaging material and a cap unit C. Reference numeral 13 denotes a top wall of the container body 12, and the cap unit C is attached to a cap attachment portion of the top wall 13 by any of various application methods such as a hot melt method, a heat sealing method, or an ultrasonic sealing method. It is to be noted that an unillustrated punched hole is formed at the cap attachment portion of the top wall 13.

The cap unit C consists of an unillustrated base paper sheet; a collar portion 15 fixed to the top wall 13 via the base paper sheet; a lid portion 16; an unillustrated pull tab, and an unillustrated inner tape. The lid portion 16 is removably fitted into the collar portion 15 via the pull tab. The pull tab covers the punched hole and is welded to the collar portion 15, the inner tape, and the packaging material of the container body 12, to thereby seal the interior of the container body 12. It is to be noted that the collar portion 15 and the lid portion 16 constitute a cap.

Next, a method of manufacturing the packaging container 11 having the above-described structure will be described.

Figure 3:
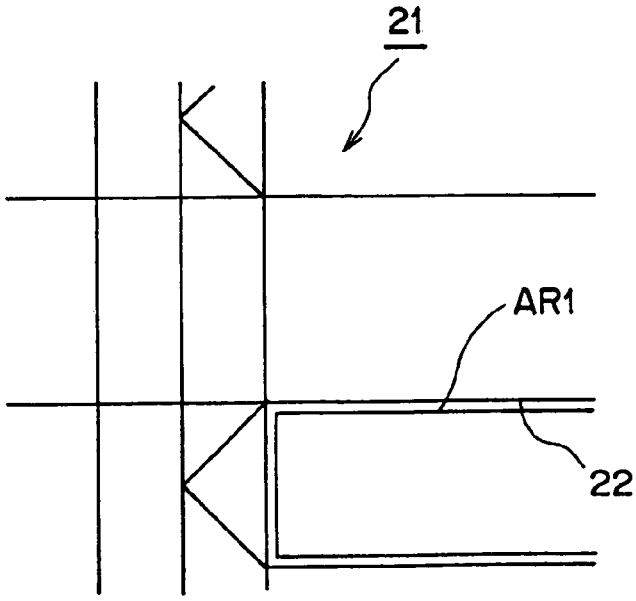
FIG. 3 is a view showing a first step of a method of manufacturing the packaging container according to the first embodiment of the present invention.
Figure 4:
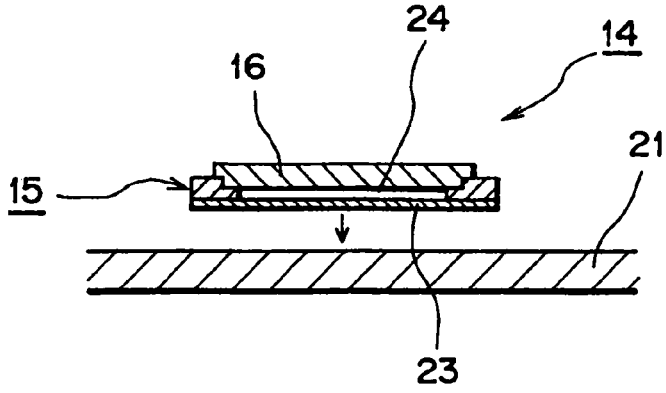
FIG. 4 is a first view showing a second step of the method of manufacturing the packaging container according to the first embodiment of the present invention.
Figure 5:
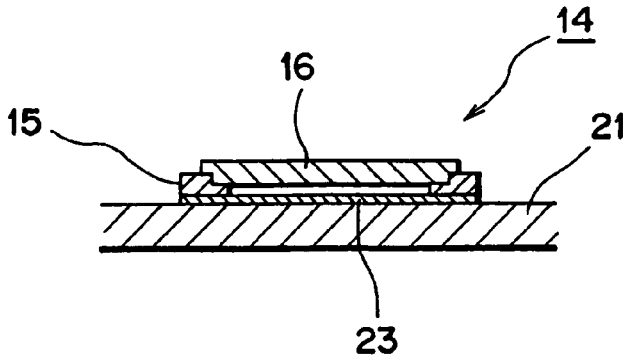
FIG. 5 is a second view showing the second step of the method of manufacturing the packaging container according to the first embodiment of the present invention.
Figure 6:
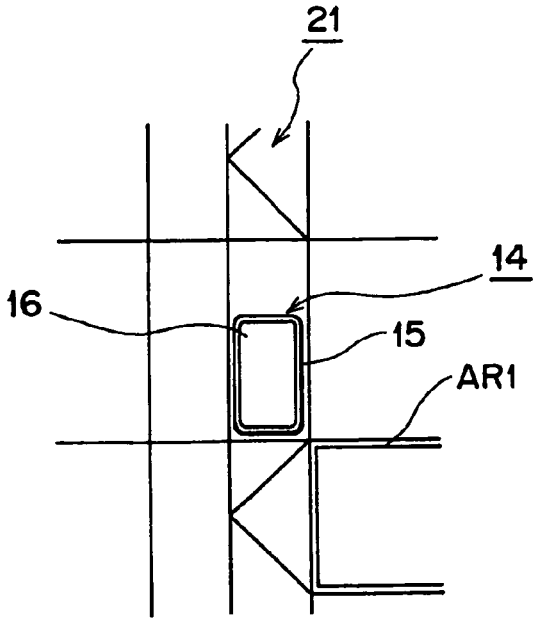
FIG. 6 is a third view showing the second step of the method of manufacturing the packaging container according to the first embodiment of the present invention.
Figure 7:
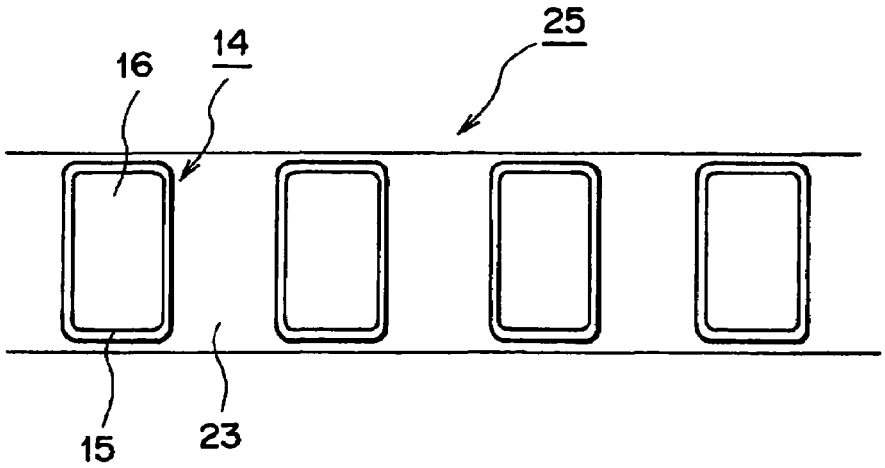
FIG. 7 is plan view of a cap sheet used in the first embodiment of the present invention.
Figure 8:
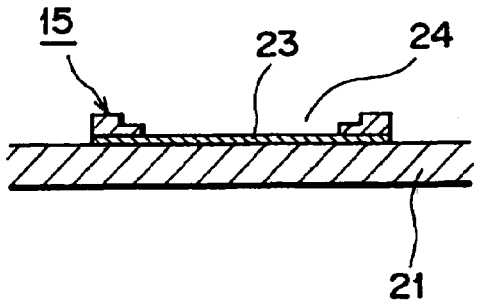
FIG. 8 is a view showing a third step of the method of manufacturing the packaging container according to the first embodiment of the present invention.
Figure 9:
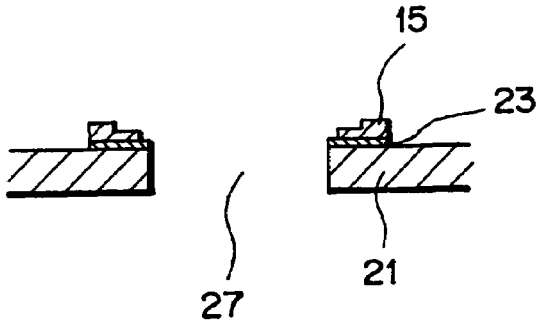
FIG. 9 is a first view showing a fourth step of the method of manufacturing the packaging container according to the first embodiment of the present invention.
Figure 10:
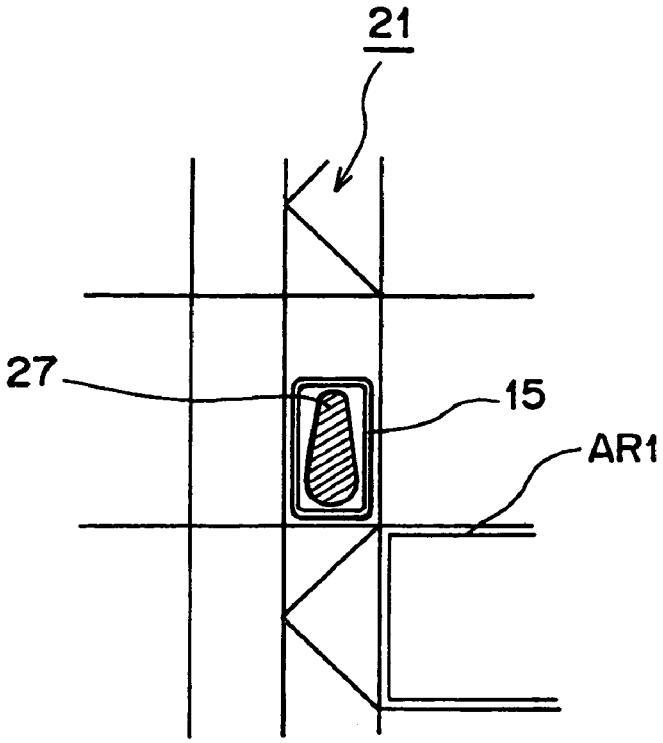
FIG. 10 is a second view showing the fourth step of the method of manufacturing the packaging container according to the first embodiment of the present invention.
Figure 11:
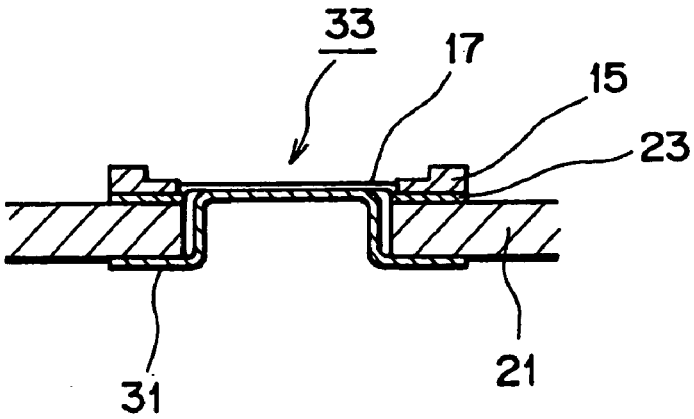
FIG. 11 is a first view showing a fifth step of the method of manufacturing the packaging container according to the first embodiment of the present invention.
Figure 12:
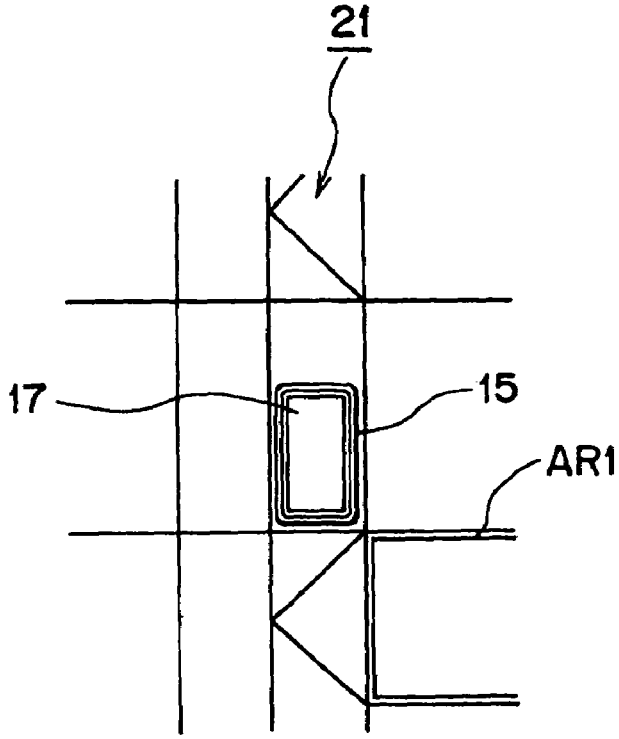
FIG. 12 is a second view showing the fifth step of the method of manufacturing the packaging container according to the first embodiment of the present invention.
Figure 13:
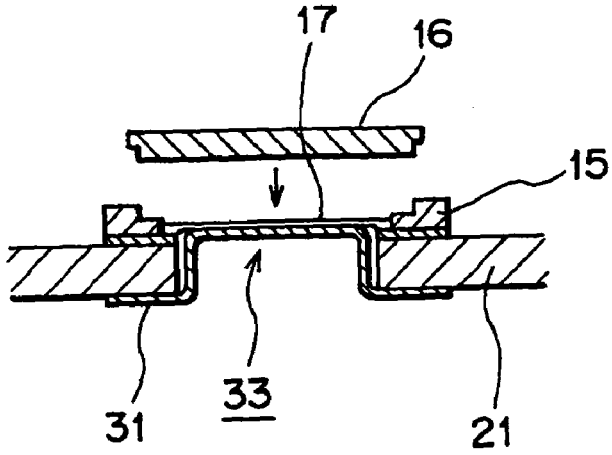
FIG. 13 is a view showing a sixth step of the method of manufacturing the packaging container according to the first embodiment of the present invention.

FIG. 3 is a view showing a first step of a method of manufacturing the packaging container according to the first embodiment of the present invention; FIG. 4 is a first view showing a second step of the method of manufacturing the packaging container according to the first embodiment of the present invention; FIG. 5 is a second view showing the second step of the method of manufacturing the packaging container according to the first embodiment of the present invention; FIG. 6 is a third view showing the second step of the method of manufacturing the packaging container according to the first embodiment of the present invention; FIG. 7 is plan view of a cap sheet according to the first embodiment of the present invention; FIG. 8 is a view showing a third step of the method of manufacturing the packaging container according to the first embodiment of the present invention; FIG. 9 is a first view showing a fourth step of the method of manufacturing the packaging container according to the first embodiment of the present invention; FIG. 10 is a second view showing the fourth step of the method of manufacturing the packaging container according to the first embodiment of the present invention; FIG. 11 is a first view showing a fifth step of the method of manufacturing the packaging container according to the first embodiment of the present invention; FIG. 12 is a second view showing the fifth step of the method of manufacturing the packaging container according to the first embodiment of the present invention; and FIG. 13 is a view showing a sixth step of the method of manufacturing the packaging container according to the first embodiment of the present invention.

In FIG. 3, reference numeral 21 denotes a packaging material, and reference numeral 22 denotes a creasing line, which is formed at a predetermined portion of the packaging material 21 in accordance with the shape of the container body 12 (FIG. 2). Reference symbol AR1 denotes a display area which is defined at a predetermined position of the packaging material 21 and within which a product name, ingredients, production date, and other data are displayed in accordance with a standard, a law, or the like.

The packaging material 21 has a multilayer structure and includes an unillustrated paper substrate and an unillustrated polyethylene resin layer coated on either side of the paper substrate. If necessary, aluminum foil serving as a gas barrier layer may be disposed between the paper substrate and the polyethylene resin layer.

In a first step, the packaging material 21 is transported along an unillustrated packaging material transport path by means of an unillustrated conveyer serving as a packaging material transport apparatus, and fed to a cap attachment station defined at a predetermined position on the packaging material transport path. In a second step, as shown in FIGS. 4 to 6, a cap 14 is attached to the packaging material 21 at a predetermined position by means of a cap applicator disposed at the cap attachment station.

The cap 14 has a rectangular shape and consists of a frame-shaped collar portion 15 and a lid portion 16. The collar portion 15 has an opening 24 at the center thereof. The lid portion 16 is removably fitted into the collar portion 15 so as to cover the opening 24. Upon removal of the lid portion 16 from the collar portion 15, the cap 14 is brought into an opened state, and upon the lid portion 16 being fitted into the collar portion 15, the cap 14 is brought into a closed state.

In the present embodiment, the collar portion 15 and the lid portion 16 are configured to be separable from each other. However, the lid portion 16 may be connected integrally with the collar portion 15 via a thin-wall portion formed of resin, or may be pivotably connected to the collar portion 15 via a hinge or the like.

As shown in FIG. 7, the cap 14 is welded on to a web-like base sheet 23, which is fed to the cap attachment station as a cap sheet 25. When the cap sheet 25 reaches the cap applicator, the cap applicator separates and holds each cap 14, and, as shown in FIG. 4, presses the cap 14 against the packaging material 21 in the direction of an arrow, with the base sheet 23 being interposed between the cap 14 and the packaging material 21.

The base sheet 23 has a three-layer structure in which a polyethylene resin layer is coated on either side of an aluminum layer. Subsequently, an induction heating apparatus of the cap applicator is driven so as to induction-heat the aluminum layer to thereby melt each of the polyethylene resin layers. As a result, the polyethylene resin layers are welded to the collar portion 15 and the packaging material 21, whereby the cap 14 is attached to the packaging material 21.

In a third step, a picking apparatus of the cap applicator is driven in order to remove the lid portion 16 to thereby bring the cap 14 into an opened state, in which the opening 24 is exposed as shown in FIG. 8. In a fourth step, a punching apparatus of the cap applicator is driven in order to punch the packaging material 21 and the base sheet 23 to thereby form the punched hole 27 in the packaging material 21 and the base sheet 23 in a discharge opening portion which is defined to correspond to the above-described cap attachment portion, as shown in FIGS. 9 and 10. In the case of the cap in which the lid portion is swingably disposed by use of a hinge or the like, in the third step, the lid portion is rotated to bring the cap into an opened state.

In a fifth step, a pull-tab welding apparatus of the cap applicator is driven. As a result, as shown in FIGS. 11 and 12, an inner tape 31 is welded to the discharge opening portion in order to cover the discharge opening portion and the punched hole 27 from the reverse side of the packaging material 21; a pull tab 17 is welded to the discharge opening portion in order to cover the discharge opening portion and the punched hole 27, which are surrounded by the collar portion 15, from the outer side of the packaging material 21; and the inner tape 31 and the pull tab 17 are welded to each other. Consequently, a thin-film-like rupture portion 33 formed of the inner tape 31 and the pull tab 17 is formed at a portion corresponding to the punched hole 27. The pull tab 17 has a three-layer structure in which a polyethylene resin layer is coated on either side of an aluminum layer.

In a sixth step, the picking apparatus is driven again, so that, as shown in FIG. 13, the lid portion 16 is pressed against the rupture portion 33 in the direction of an arrow. As a result, the lid portion 16 is fitted into the collar portion 15. In the case of the cap in which the lid portion is swingably disposed by use of a hinge or the like, in the sixth step, the lid portion is rotated to bring the cap into a closed state.

In the above-described manner, a cap unit C is formed, and attachment of the cap 14 onto the packaging material 21 is completed. The above-described second to sixth steps constitute a cap attachment step.

In the present embodiment, since the cap 14 has the collar portion 15 and the lid portion 16, the cap 14 can be brought into an opened state and a closed state through removal of the lid portion 16 from the collar portion 15 and fitting of the lid portion 16 into the collar portion 15. However, when a cap having no lid portion is attached to the container body 12, the third and sixth steps are unnecessary.

Subsequently, the packaging material 21 is conveyed to an unillustrated charging machine. In the charging machine, the packaging material 21 is formed into a predetermined shape; e.g., a shape of a tube, in a forming step; and a liquid food is charged into the tubular packaging material 21 in a subsequent charging step. Subsequently, the tubular packaging material 21 is cut at predetermined intervals to thereby obtain a plurality of containers. The containers are pre-formed into a pillow shape. The thus-obtained pre-formed containers are further formed in order to obtain brick-shaped packaging containers 11.

As described above, since the cap 14 is attached to the packaging material 21 in advance, the cap 14 is not required to be attached to the container body 12 after the container body 12 is positioned.

Therefore, there is eliminated the necessity of stopping the container body 12 on the conveyer or temporarily removing the container body 12 from the conveyer and returning the same onto the conveyer after attachment of the cap 14. Accordingly, variation in the position at which the cap 14 is attached is prevented, so that the quality of the packaging container 11 can be improved. In addition, the structure of the packaging container manufacturing apparatus can be simplified, and the cost of the packaging container manufacturing apparatus can be reduced.

In the present embodiment, the packaging material 21 of a web-like shape is used for fabrication of the brick-shaped packaging container 11. However, a gable-top-type packaging container may be formed by use of a sheet-shaped packaging material.

In the present embodiment, fixation of the collar portion 15 to the packaging material 21 and welding of the pull tab 17 are performed before charging of the liquid food. However, welding of the pull tab may be performed after charging of the liquid food, because variation in the position at which the cap is attached is prevented through the fixation of the collar portion 15 to the packaging material 21 performed before charging of the liquid food.

Next, a second embodiment of the present invention will be described. Components having the same structures as those of the first embodiment are denoted by the same reference numerals, and repetition of their descriptions is omitted.

Figure 14:
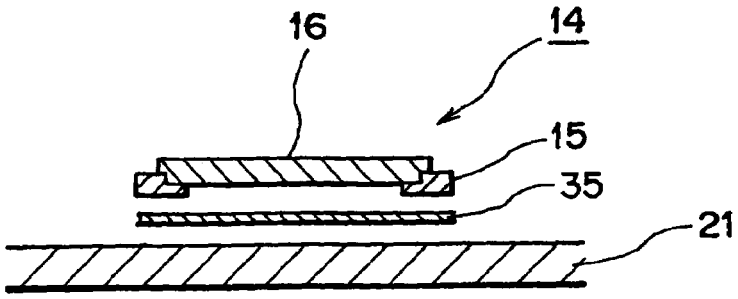
FIG. 14 is a view showing a method of manufacturing a packaging container according to a second embodiment of the present invention.

FIG. 14 is a view showing a method of manufacturing a packaging container according to the second embodiment of the present invention.

In a first step, the packaging material 21 is transported along an unillustrated packaging material transport path by means of an unillustrated conveyer serving as a packaging material transport apparatus, and is fed to a cap attachment station defined at a predetermined position on the packaging material transport path. In a second step, the cap 14 is attached to the packaging material 21 by means of a cap applicator disposed at the cap attachment station.

In this case, a sheet that does not include an aluminum layer is used as a base sheet, and the base sheet is removed from the cap 14 before the cap 14 is attached to the packaging material 21. A seal tape 35 is used for attachment. The seal tape 35 has a three-layer structure in which a polyethylene resin layer is coated on either side of an aluminum layer.

When the cap sheet 25 (see FIG. 7) is fed to the cap applicator, the cap applicator separates and holds each cap 14 from the cap sheet 25, inserts the seal tape 35 between the cap 14 and the packaging material 21, and attaches the cap 14 onto the packaging material 21 via the seal tape 35. For such a purpose, the induction heating apparatus of the cap applicator is driven so as to induction-heat the aluminum layer to thereby melt each of the polyethylene resin layers of the seal tape 35. As a result, the polyethylene resin layers are welded to the collar portion 15 and the packaging material 21.

Since the third and subsequent steps are the same as those in the first embodiment, their descriptions are omitted. The second to, sixth steps constitute a cap attachment step.

Next, a third embodiment of the present invention will be described. Components having the same structures as those of the first embodiment are denoted by the same reference numerals, and repetition of their descriptions is omitted.

Figure 15:
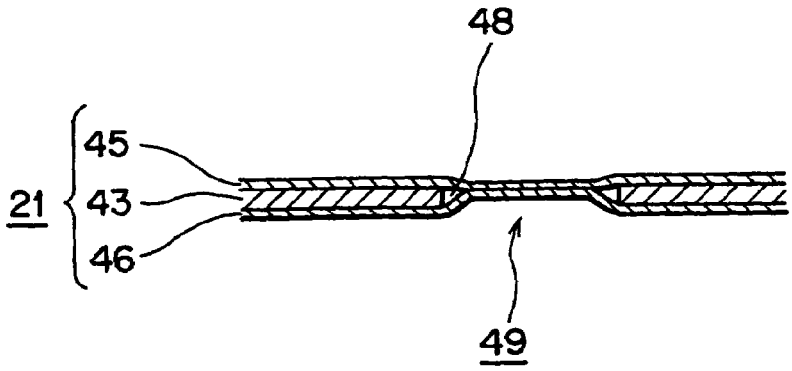
FIG. 15 is a view showing a first step of a method of manufacturing a packaging container according to a third embodiment of the present invention.
Figure 16:
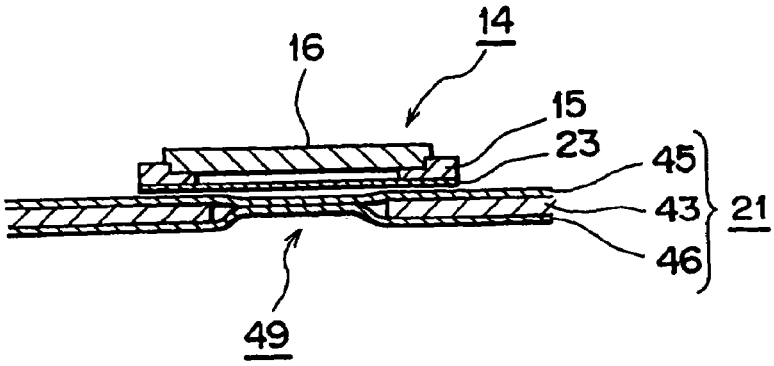
FIG. 16 is a view showing a second step of the method of manufacturing the packaging container according to the third embodiment of the present invention.
Figure 17:
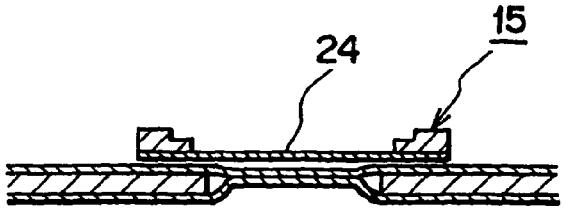
FIG. 17 is a view showing a third step of the method of manufacturing the packaging container according to the third embodiment of the present invention.
Figure 18:
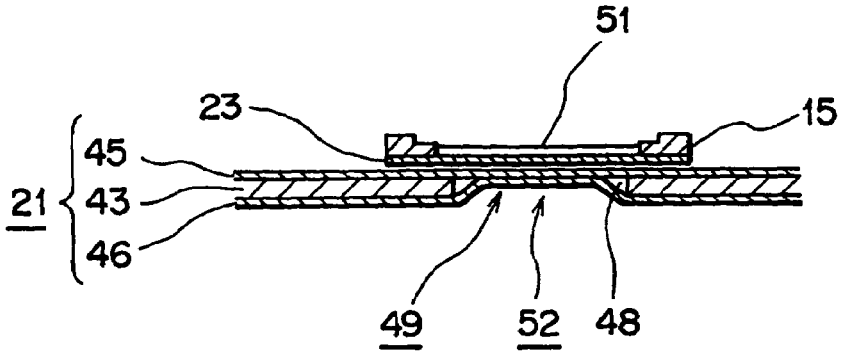
FIG. 18 is a view showing a fourth step of the method of manufacturing the packaging container according to the third embodiment of the present invention.
Figure 19:
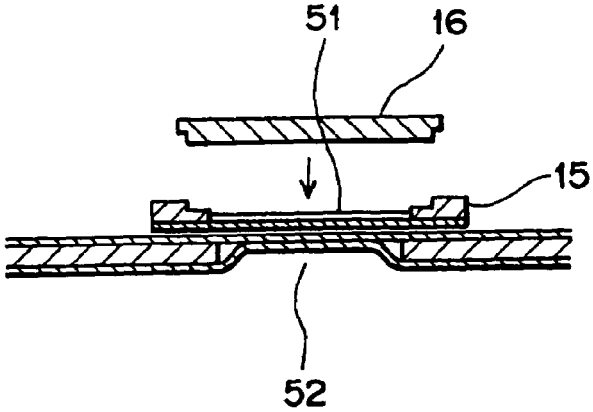
FIG. 19 is a view showing a fifth step of the method of manufacturing the packaging container according to the third embodiment of the present invention.

FIG. 15 is a view showing a first step of a method of manufacturing a packaging container according to the third embodiment of the present invention; FIG. 16 is a view showing a second step of the method of manufacturing the packaging container according to the third embodiment of the present invention; FIG. 17 is a view showing a third step of the method of manufacturing the packaging container according to the third embodiment of the present invention; FIG. 18 is a view showing a fourth step of the method of manufacturing the packaging container according to the third embodiment of the present invention; and FIG. 19 is a view showing a fifth step of the method of manufacturing the packaging container according to the third embodiment of the present invention.

As shown in FIG. 15, during the stage of fabricating the packaging material 21, a thin wall portion 49 is formed in the packaging material 21 beforehand. The packaging material 21 has a multilayer structure and includes a paper substrate 43 and polyethylene resin layers 45 and 46 coated on opposite sides of the paper substrate 43. If necessary, aluminum foil serving as a gas barrier layer may be disposed between the paper substrate 43 and the polyethylene resin layer 46. After a punched hole 48 is formed in a discharge opening portion of the paper substrate 43 which is defined to correspond to the cap attachment portion, the polyethylene resin layers 45 and 46 are coated on opposite sides of the paper substrate 43. Subsequently, the polyethylene resin layers 45 and 46 are welded together at a portion corresponding to the punched hole 48 to thereby form the above-described thin wall portion 49.

In a first step, the packaging material 21 is transported along an unillustrated packaging material transport path by means of an unillustrated conveyer serving as a packaging material transport apparatus, and is fed to a cap attachment station defined at a predetermined position on the packaging material transport path. In a second step, as shown in FIG. 16, the cap 14 is attached to the packaging material 21 by means of the cap applicator disposed at the cap attachment station.

In this case, the cap 14 is attached to face the thin wall portion 49. For this purpose, an unillustrated mark for positioning is printed at a predetermined position on the surface of the packaging material 21. Through use of an unillustrated sensor for reading the mark, the cap 14 can be easily positioned in relation to the packaging material 21.

As in the case of the first embodiment, the cap 14 is welded on to a web-like base sheet 23, which is fed to the cap attachment station as a cap sheet 25 (FIG. 7).

In a third step, the picking apparatus of the cap applicator is driven in order to remove the lid portion 16 to thereby bring the cap 14 into a state such that the opening 24 is exposed as shown in FIG. 17. In a fourth step, an unillustrated pull-tab welding apparatus is driven, so that a pull tab 51 is welded onto the base sheet 23 such that, as shown in FIG. 18, the pull tab 51 covers the discharge opening portion from the outer side of the packaging material 21, and the base sheet 23 and the thin wall portion 49 are welded to each other. Consequently, a thin-film-like rupture portion 52 formed of the base sheet 23, the polyethylene resin layers 45 and 46, and the pull tab 51 is formed at the discharge opening portion. In the case of the cap in which the lid portion is swingably disposed by use of a hinge or the like, in the third step, the lid portion is rotated so as to bring the cap into an opened state. The pull tab 51 has a three-layer structure in which a polyethylene resin layer is coated on either side of an aluminum layer and is welded to the base sheet 23 by means of induction heating.

In a fifth step, the picking apparatus is driven again, so that, as shown in FIG. 19, the lid portion 16 is pressed against the rupture portion 52 in the direction of an arrow. As a result, the lid portion 16 is fitted into the collar portion 15. The second to fifth steps constitute a cap attachment step.

In the present embodiment, since the cap 14 has the collar portion 15 and the lid portion 16, the cap 14 can be brought into an opened state and a closed state through removal of the lid portion 16 from the collar portion 15 and fitting of the lid portion 16 into the collar portion 15. However, when a cap having no lid portion is attached to the container body 12 (FIG. 2), the third and fifth steps are unnecessary.

When the cap unit C is formed, and attachment of the cap 14 onto the packaging material 21 is completed in the above-described manner, the packaging material 21 is conveyed to an unillustrated charging machine. In the charging machine, the packaging material 21 is formed into a predetermined shape, and a liquid food is charged therein to thereby complete the packaging container 11.

In this case, since the cap 14 is attached to the packaging material 21 in advance, the cap 14 is not required to be attached to the container body 12 after the container body 12 is positioned.

Therefore, there is eliminated the necessity of stopping the container body 12 on the conveyer or temporarily removing the container body 12 from the conveyer and returning it onto the conveyer after attachment of the cap 14. Accordingly, variation in the position at which the cap 14 is attached is prevented, so that the quality of the packaging container 11 can be improved. In addition, the structure of the packaging container manufacturing apparatus can be simplified, and the cost of the packaging container manufacturing apparatus can be reduced.

In addition, since the punched hole 48 and the thin wall portion 49 are formed in advance in the stage of fabricating the packaging material 21, formation of the punched hole in a step subsequent to the third step is not required. Accordingly, the work can be simplified.

Moreover, since the punched hole is not formed in the packaging material 21 immediately before the liquid food is charged, generation of pin holes in the packaging material 21 can be suppressed.

Next, a fourth embodiment of the present invention will be described. Components having the same structures as those of the first embodiment are denoted by the same reference numerals, and repetition of their descriptions is omitted.

Figure 20:
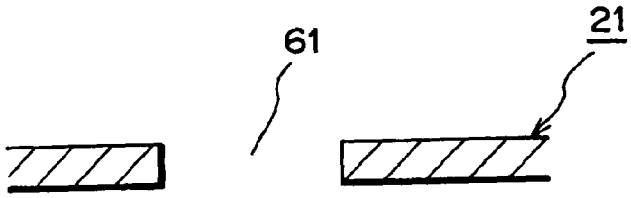
FIG. 20 is a view showing a first step of a method of manufacturing a packaging container according to a fourth embodiment of the present invention.
Figure 21:
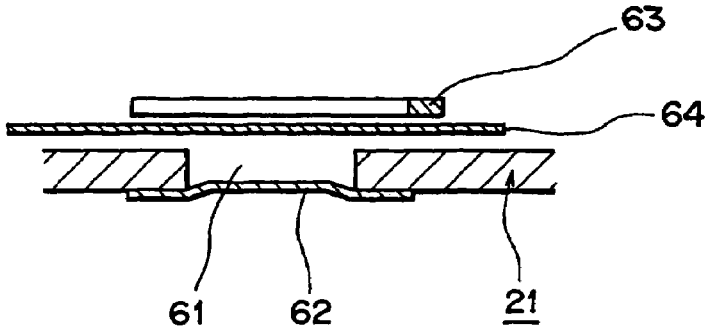
FIG. 21 is a first view showing a second step of the method of manufacturing the packaging container according to the fourth embodiment of the present invention.
Figure 22:
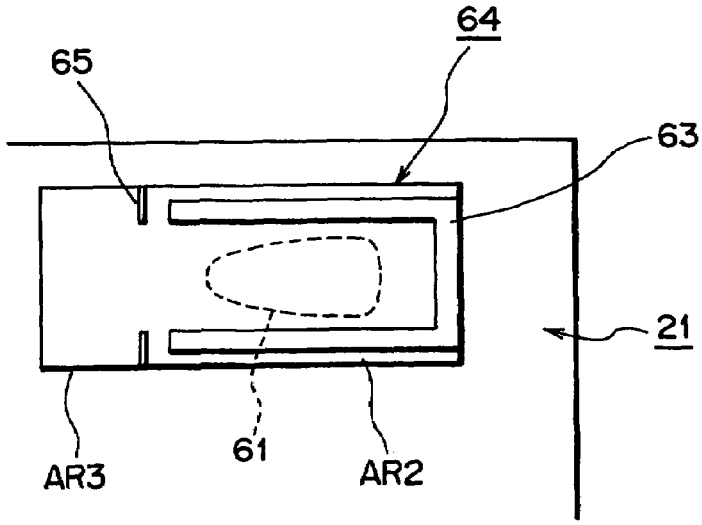
FIG. 22 is a second view showing the second step of the method of manufacturing the packaging container according to the fourth embodiment of the present invention.

FIG. 20 is a view showing a first step of a method of manufacturing a packaging container according to the fourth embodiment of the present invention; FIG. 21 is a first view showing a second step of the method of manufacturing the packaging container according to the fourth embodiment of the present invention; FIG. 22 is a second view showing the second step of the method of manufacturing the packaging container according to the fourth embodiment of the present invention; and FIG. 23 is a third view showing the second step of the method of manufacturing the packaging container according to the fourth embodiment of the present invention.

In this case, the cap has a U-shaped lip 63, and a pull tab 64. In a first step, a punching apparatus of an unillustrated cap applicator is driven in order to punch a packaging material 21 to thereby form a punched hole 61 in the packaging material 21 in a discharge opening portion which is defined to correspond to the cap attachment position, as shown in FIG. 20.

Figure 23:
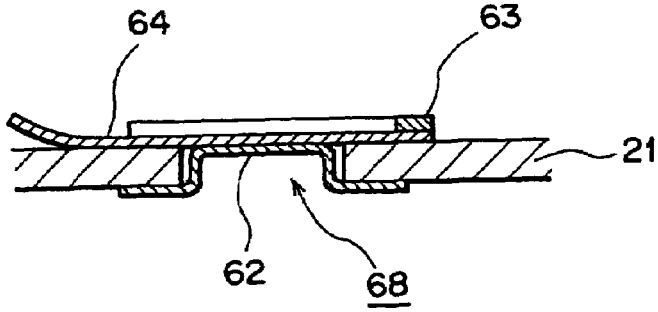
FIG. 23 is a third view showing the second step of the method of manufacturing the packaging container according to the fourth embodiment of the present invention.

In a second step, as shown in FIG. 21, an inner tape 62 is welded to the reverse surface of the packaging material 21 in order to cover the punched hole 61; and, as shown in FIGS. 21 to 23, the pull tab 64 is welded to the outer surface of the packaging material 21 in order to cover the discharge opening portion. Simultaneously, the lip 63 is fixed to the outer surface of the packaging material 21 via the pull tab 64. The pull tab 64 has a three-layer structure in which a polyethylene resin layer is coated on either side of an aluminum layer. Through induction heating, the pull tab 64 is welded to the lip 63, the packaging material 21, and the inner tape 62. As a result, the inner tape 62 and the pull tab 64 form a rupture portion 68.

Although a portion AR2 of the pull tab 64 is welded to the lip 63, the packaging material 21, and the inner tape 62, the remaining portion AR3 of the pull tab 64 is not welded to the packaging material 21. Further, slits 65 are formed between the portions AR2 and AR3. The above-described first and second step constitute a cap attachment step.

In this case, when a person holds the portion AR3 with fingers and peels off the pull tab 64, the rupture portion 68 is broken, whereby an unillustrated discharge opening is formed.

Next, a fifth embodiment of the present invention will be described.

Figure 24:
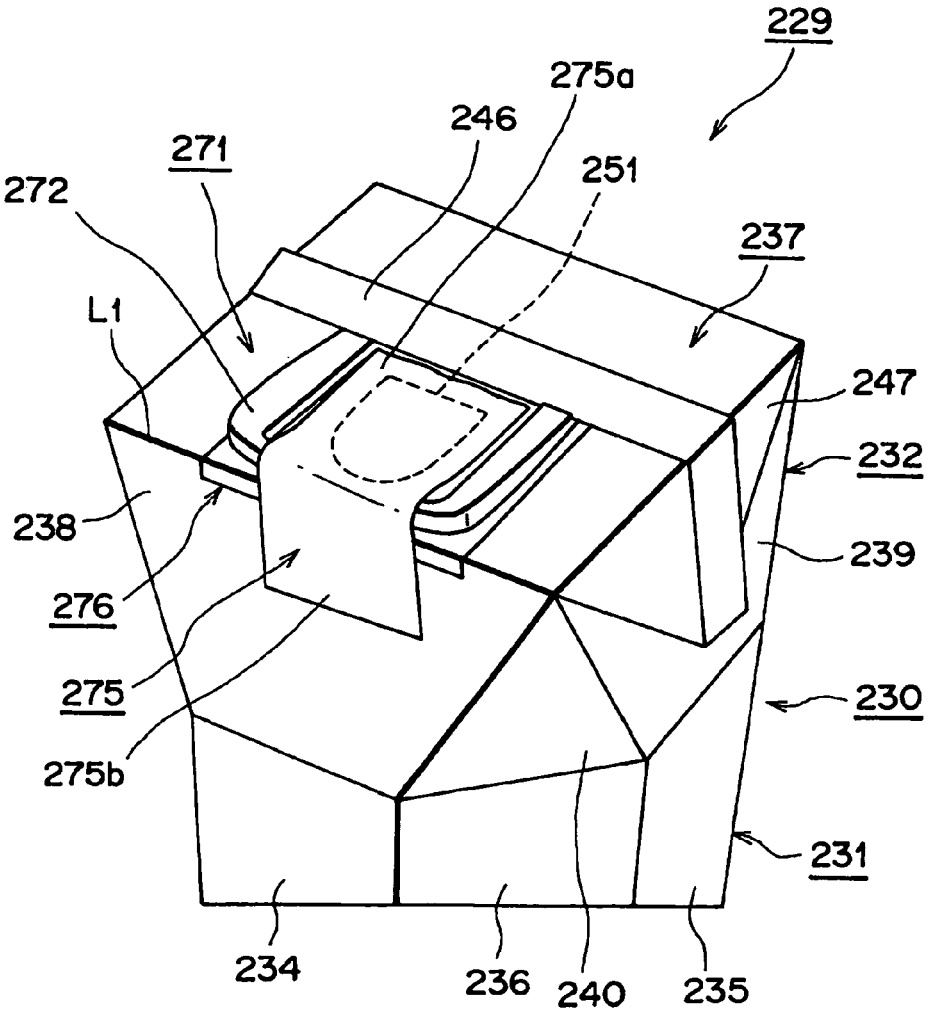
FIG. 24 is a view showing an initial state of a packaging container according to a fifth embodiment of the present invention.
Figure 25:
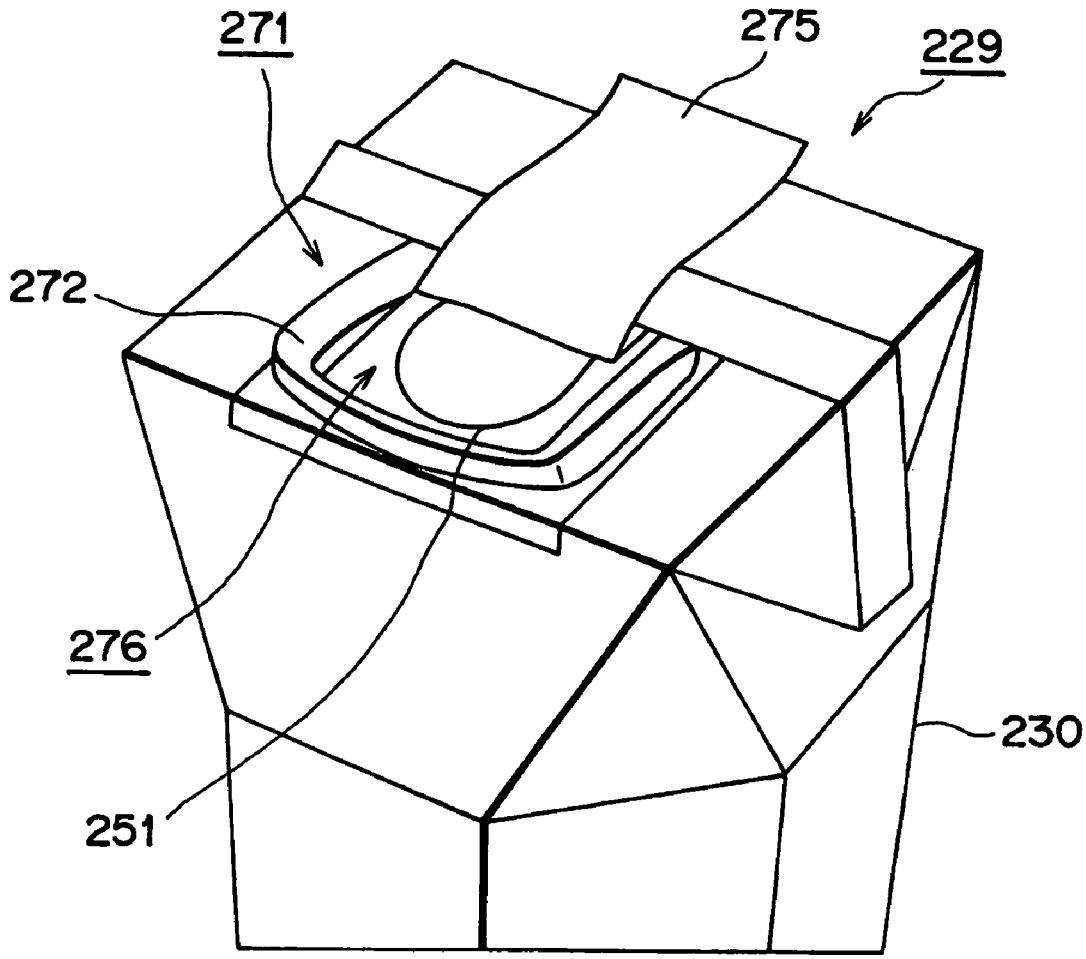
FIG. 25 is a view showing an opened state of the packaging container according to the fifth embodiment of the present invention.

FIG. 24 is a view showing an initial state of a packaging container according to the fifth embodiment of the present invention; and FIG. 25 is a view showing an opened state of the packaging container according to the fifth embodiment of the present invention.

In FIGS. 24 and 25, reference numeral 229 denotes a packaging container; and 230 denotes a container body. The container body 230 has a body portion 231 having a substantially octagonal cross section, an upper end portion 232 which extends upward from the body portion 231 and has a substantially octagonal cross section at its lower end and a substantially rectangular cross section at its upper end, and an unillustrated lower portion which extends downward from the body portion 231 and has a substantially octagonal cross section at its upper end and a substantially rectangular cross section at its lower end. The body portion 231 is formed by a front wall 234, an unillustrated rear wall, two side walls 235 (only one side wall 235 is shown in FIGS. 24 and 25), and four body portion connection walls 236 disposed between the front wall 234 and the side walls 235 and between the rear wall and the side walls 235 (only one body portion connection wall 236 is shown in FIGS. 24 and 25). Each of the front wall 234, the rear wall, the side walls 235, and the body portion connection walls 236 has a rectangular shape.

The upper end portion 232 is formed by a top wall 237, a front wall 238 connecting the top wall 237 and the front wall 234, an unillustrated rear wall connecting the top wall 237 and the above-described rear wall, two side walls 239 connecting the top wall 237 and the side walls 235 (only one side wall 239 is shown in FIGS. 24 and 25), and four connection walls 240 connecting the top wall 237 and the body portion connection walls 236 (only one connection wall 240 is shown in FIGS. 24 and 25). Each of the front wall 238, the rear wall, and the side walls 239 has a trapezoidal shape in which the upper side is longer than the lower side. Each of the connection walls 240 has a shape of a triangle whose one apex is located on the top wall 237. Reference numeral 246 denotes a seal portion formed at the center of the top wall 237, and 247 denotes two tab portions (only one tab portion 247 is shown in FIGS. 24 and 25). Each tab portion 247 is welded to the corresponding side wall 239.

The lower end portion is formed by a bottom wall, a front wall connecting the bottom wall and the front wall 234, a rear wall connecting the bottom wall and the above-described rear wall, two side walls connecting the bottom wall and the side walls 235, and four connection walls connecting the bottom wall and the body portion connection walls 236.

The container body 230 is fabricated through formation of a packaging material. For such purpose, creasing lines are formed on the packaging material in advance, and the packaging material is folded along the creasing lines in order to form a pre-formed container. Subsequently, the pre-formed container is subjected to a forming process in order to obtain the container body 230 having a final shape. The packaging material is formed of a flexible laminate which includes an unillustrated paper substrate, an unillustrated outermost layer formed of a polyethylene resin or a like resin and coated on the outer surface of the paper substrate, an unillustrated gas barrier layer coated on the reverse surface of the paper substrate, and an unillustrated innermost layer formed of a polyethylene resin or a like resin and coated on the reverse surface of the gas barrier layer.

A lip 211 is fixed onto the top wall 237 through bonding, welding, or any other suitable attachment method, such that the lip 271 is located, for example, at a substantial center and in the vicinity of a boundary L1 between the top wall 237 and the front wall 238. The lip 271 consists of a U-shaped thick portion 272 and an outer patch seal 276. The thick portion 272 is formed integrally through injection molding performed such that resin adheres onto the outer patch seal 276. The thick portion 272 does not have a lid. A discharge opening 251 in the form of a punched hole is formed in a discharge opening portion defined at a predetermined position on the top wall 237 and the outer patch seal 276.

In this case, since the outer patch seal 276 is present around the thick portion 272, a person obtains a pleasant sensation upon placement of his/her lips on portions around the thick portion 272.

A pull tab 275 is bonded to the outer surface of the packaging material such that the pull tab 275 covers the discharge opening portion, a space within the thick portion 272, and the vicinity of the boundary L1. The pull tab 275 consists of a gas barrier layer formed of aluminum foil, an outermost layer formed of a polyethylene resin or a like resin and coated on the outer surface of the gas barrier layer, and an innermost layer formed of a polyethylene resin or a like resin and coated on the reverse surface of the gas barrier layer. The pull tab 275 has a horizontal portion 275*a* and a vertical portion 275*b*. The horizontal portion 275*a* has an area greater than that of the discharge opening 251, and upon attachment to the packaging material extends along the top wall 237 and covers the vicinity of the discharge opening 251 to thereby prevent the vicinity from being dirtied. The vertical portion 275*b* extends along the front wall 238 and serves as a tab used for peeling off the pull tab 275. Further, an unillustrated inner tape is applied onto the reverse surface of the top wall 237 portion of the packaging material and is welded to the pull tab 275 and a portion of the packaging material around the discharge opening 251. The lip 271 and the pull tab 275 constitute a cap and a cap unit.

Accordingly, as shown in FIG. 25, when the pull tab 275 is peeled off the container body 230 to thereby rupture the inner tape, the discharge opening 251 is formed, whereby the packaging container 229 is opened. Subsequently, a person places his/her lips on the opened discharge opening 251 in order to drink the liquid food directly. Since the thick portion 272 is present around the discharge opening portion, the person obtains a pleasant sensation upon placement of his/her lips on portions around the discharge opening portion and the discharge opening 251. In addition, drinking the liquid food is easy, and does not require use of a straw.

Further, the person can pour the liquid food from the discharge opening 251 into an unillustrated container such as glass by means of tilting the packaging container 229.

In the present embodiment, the thick portion 272 is formed to extend along the front edge and side edges of the discharge opening 251 to thereby form a U-like shape. However, the thick portion may be formed to extend along the inner circumferential edge of the discharge opening 251 to thereby form a closed loop. In the present embodiment, the discharge opening 251 is a punched hole formed in the discharge opening portion, and is opened upon peeling off of the pull tab 275. This structure may be modified such that a hole is formed in advance in the outer patch seal 276 only; a rupture portion is formed in the top wall 237 through formation of perforations, pre-laminate, or a half-cut portion; and the rupture portion is broken upon pulling up of the pull tab 275 to open the discharge opening. In this case, the inner tape is unnecessary.

As described above, since the thick portion 272 is formed integrally on the outer patch seal 276, the step of fabricating the packaging container 229 can be simplified. Further, since the outer patch seal 276 can be rendered very thin, the packaging material can be folded with ease even after the lip 271 is bonded to the packaging material.

Next, a modification of the pull tab 275 will be described. Components having the same structures as those shown in FIG. 24 are denoted by the same reference numerals, and repetition of their descriptions is omitted.

Figure 26:
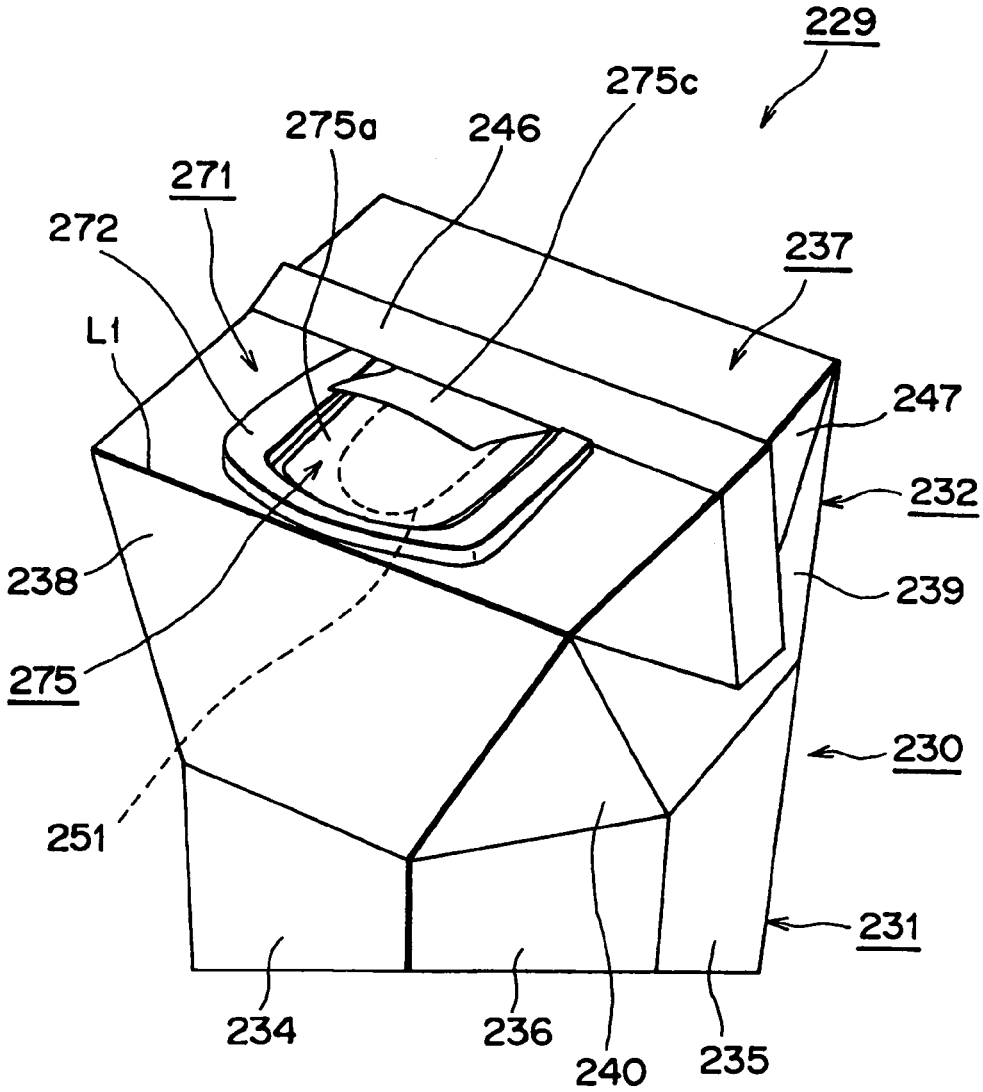
FIG. 26 is a view showing a modification of the pull tab used in the fifth embodiment of the present invention.

FIG. 26 is a view showing a modification of the pull tab used in the fifth embodiment of the present invention.

In this modification, the pull tab 275 has a horizontal portion 275*a* and a vertical portion 275*c*. The horizontal portion 275*a* has an area greater than that of the discharge opening 251, and upon attachment to the packaging material extends along the top wall 237 and covers the vicinity of the discharge opening 251 to thereby prevent the vicinity from being dirtied. The vertical portion 275*c* extends upward from the rear edge of the horizontal portion 275*a* in the vicinity of the seal portion 246 and serves as a tab used for peeling off the pull tab 275. Therefore, when the packaging container 229 is opened, the vertical portion 275*c* is pulled toward the side of the front wall 238. The lip 271 and the pull tab 275 constitute a cap and a cap unit.

A method of manufacturing the packaging container 229 will now be described.

Figure 27:
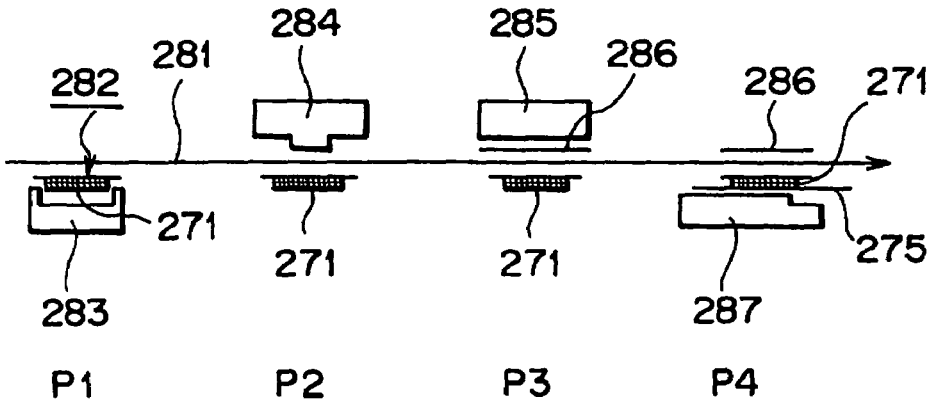
FIG. 27 is a view showing a method of manufacturing the packaging container according to the fifth embodiment of the present invention.
Figure 28:
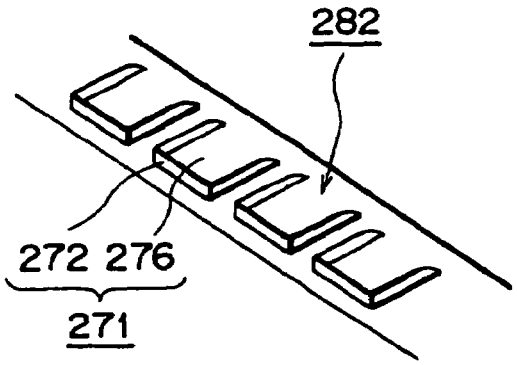
FIG. 28 is a perspective view of a lip tape used in the fifth embodiment of the present invention.

FIG. 27 is a view showing a method of manufacturing a packaging container according to the fifth embodiment of the present invention; and FIG. 28 is a perspective view of a lip tape used in the fifth embodiment of the present invention. In FIG. 27, symbols P1 to P4 represent the first through fourth steps of the method of manufacturing the packaging container 229 (FIG. 24).

In FIGS. 27 and 28, reference numeral 271 denotes a lip; 272 denotes a thick portion; 276 denotes an outer patch seal; 281 denotes a packaging material; and 282 denotes a lip tape. A plurality of lips 271 are successively formed on the lip tape 282.

In the first step P1, an outer seal apparatus 283 separates one of the lips 271 from the lip tape 282 by use of an unillustrated cutter, and fixes it onto the outer surface of the packaging material 281 through, for example, resistance heating, induction heating, or ultrasonic heating, by use of unillustrated sealing means. In the second step P2, a punching apparatus 284 forms an unillustrated hole, which is to be used as the discharge opening 251, in a discharge opening portion defined at a predetermined position on the packaging material 281 and the outer patch seal 276. In the third step P3, an inner seal apparatus 285 bonds an inner tape 286 onto the reverse surface of the packaging material 281 by use of sealing means. Subsequently, in the fourth step P4, a pull tab seal apparatus 287 bonds a pull tab 275 onto the lip 271 and the outer surface of the packaging material 281 by use of sealing means.

Next, a method of fabricating the lip tape 282 will be described.

Figure 29:
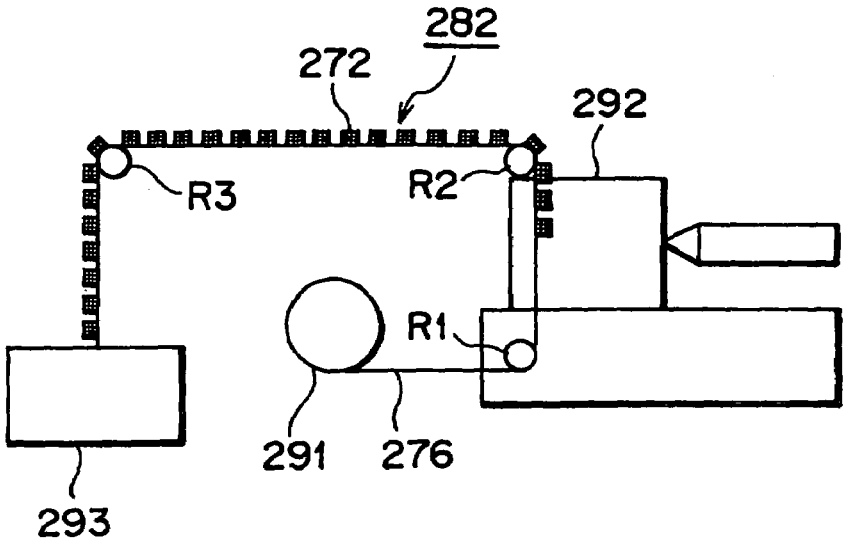
FIG. 29 is a schematic view of a lip tape manufacturing apparatus used in the fifth embodiment of the present invention.

FIG. 29 is a schematic view of a lip tape manufacturing apparatus used in the fifth embodiment of the present invention.

In FIG. 29, reference numeral 272 denotes a thick portion; 276 denotes an outer patch seal; 282 denotes a lip tape, 291 denotes a reel of the outer patch seal 276; 292 denotes an injection molding machine; and 293 denotes an accommodation box for accommodating the lip tape 282. The outer patch seal 276 unwound from the reel 291 is transported by transport rollers R1 to R3, during which the outer patch seal 276 passes through the injection molding machine 292, in which resin is applied onto the outer patch seal 276 to thereby form thick portions 272 thereon. In this manner, the lip tape 282 is fabricated.

Next, a sixth embodiment of the present invention will be described.

Figure 30:
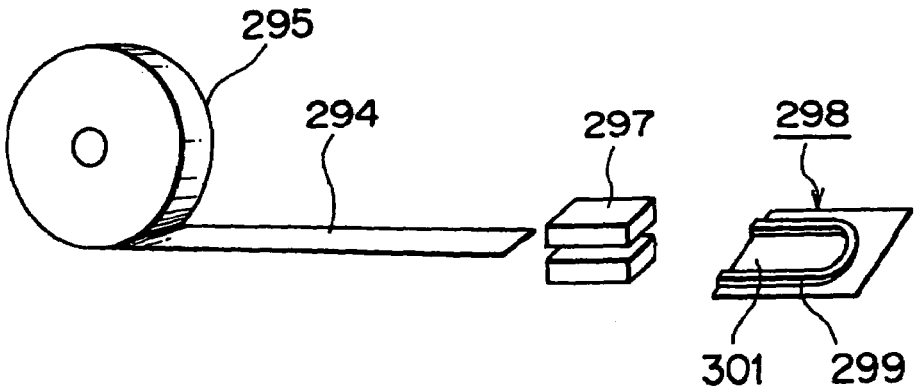
FIG. 30 is a schematic view of a lip manufacturing apparatus used in a sixth embodiment of the present invention.
Figure 31:
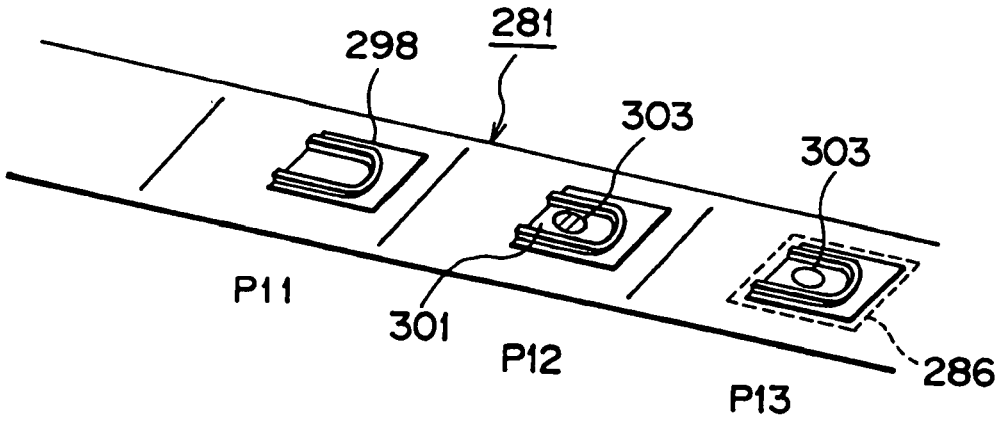
FIG. 31 is a perspective view showing a method of manufacturing a packaging container according to the sixth embodiment of the present invention.

FIG. 30 is a schematic view of a lip manufacturing apparatus used in the sixth embodiment of the present invention; and FIG. 31 is a perspective view showing a method of manufacturing a packaging container according to the sixth embodiment of the present invention. In FIG. 31, symbols P11 to P13 represent first through third steps of the method of manufacturing the packaging container.

In FIG. 30, reference numeral 294 denotes a film; 295 denotes a reel of the film 294; 297 denotes heating blocks; and 298 denotes a lip which is formed from the film 294 through an operation of sandwiching the film 294 between the heating blocks 297 and heating the film 294 in order to deform thermally. The lip 298 includes a flat plate-shaped portion 301 and a U-shaped thick portion 299 having no lid. Each heating block 297 has a mold having a shape corresponding to the shape of the thick portion 299.

In the first step P11, an unillustrated outer seal apparatus fixes the lip 298 onto the outer surface of the packaging material 281 through; for example, resistance heating, induction heating, or ultrasonic heating, by use of unillustrated sealing means. In the second step P12, an unillustrated punching apparatus forms a hole 303 in the discharge opening portions defined at predetermined positions of the packaging material 281 and the plate-shaped portion 301. The hole 303 serves as a discharge opening. In the third step P13, an unillustrated inner seal apparatus bonds an inner tape 286 onto the reverse surface of the packaging material 281 by use of sealing means.

Next, a seventh embodiment of the present invention will be described. Components having the same structures as those of the fifth embodiment are denoted by the same reference numerals, and repetition of their descriptions is omitted.

Figure 32:
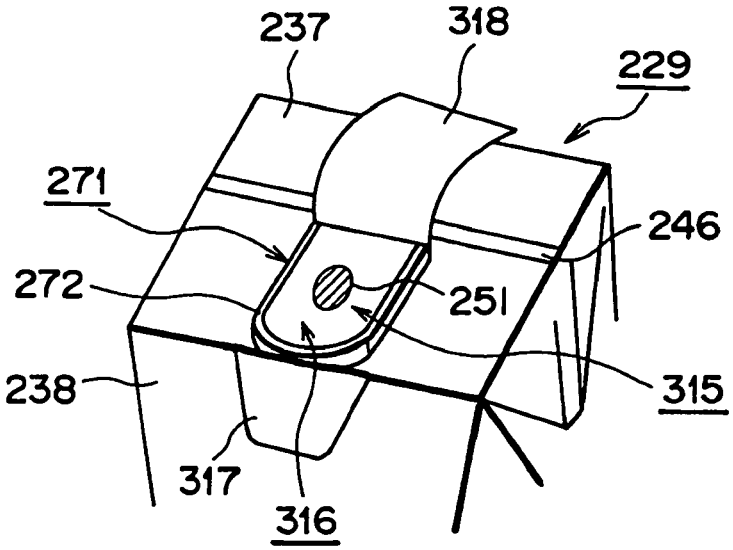
FIG. 32 is a view showing an opened state of a packaging container according to a seventh embodiment of the present invention.
Figure 33:
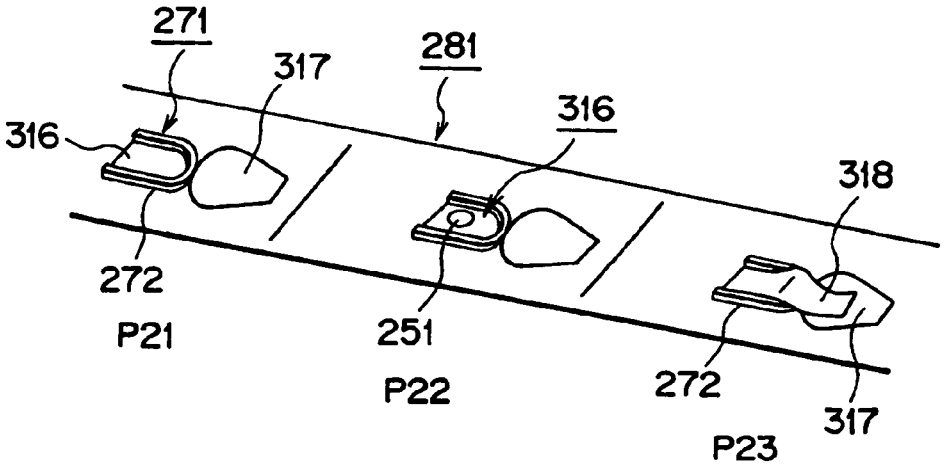
FIG. 33 is a perspective view showing a method of manufacturing the packaging container according to the seventh embodiment of the present invention.

FIG. 32 is a view showing an opened state of a packaging container according to the seventh embodiment of the present invention; and FIG. 33 is a perspective view showing a method of manufacturing the packaging container according to the seventh embodiment of the present invention. In FIG. 33, symbols P21 to P23 represent first through third steps of the method of manufacturing the packaging container 229.

In this case, the lip 271 includes an outer patch seal 315 and a thick portion 272 having no lid. The outer patch seal 315 includes a body portion 316 to be bonded to the top wall 237, and a skirt portion 317 formed integrally with the body portion 316 and adapted to be bonded to the front wall 238.

In the first step P21, an unillustrated outer seal apparatus fixes the lip 271 onto the outer surface of the packaging material 281 through, for example, resistance heating, induction heating, or ultrasonic heating, by use of unillustrated sealing means. In the second step P22, an unillustrated punching apparatus forms a discharge opening 251 in the discharge opening portions defined at predetermined positions of the packaging material 281 and the body portion 316. In the third step P23, an unillustrated inner sealing apparatus bonds an unillustrated inner tape onto the reverse surface of the packaging material 281 by use of sealing means, and an unillustrated pull tab seal apparatus bonds the pull tab 318 onto the outer surface of the packaging material 281 by use of sealing means such that the pull tab 318 covers the body portion 316, a portion of the thick portion 272, and a portion of the skirt portion 317. The lip 271 and the pull tab 318 constitute a cap and a cap unit.

Next, an eighth embodiment of the present invention will be described. Components having the same structures as those of the fifth embodiment are denoted by the same reference numerals, and repetition of their descriptions is omitted.

Figure 34:
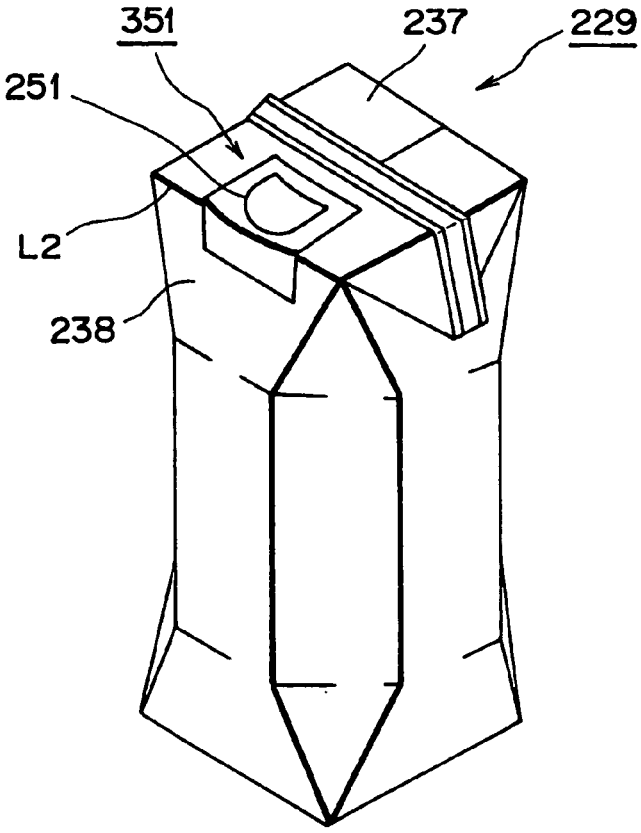
FIG. 34 is a first view showing a state of disposition of an outer patch seal used in an eighth embodiment of the present invention.
Figure 35:
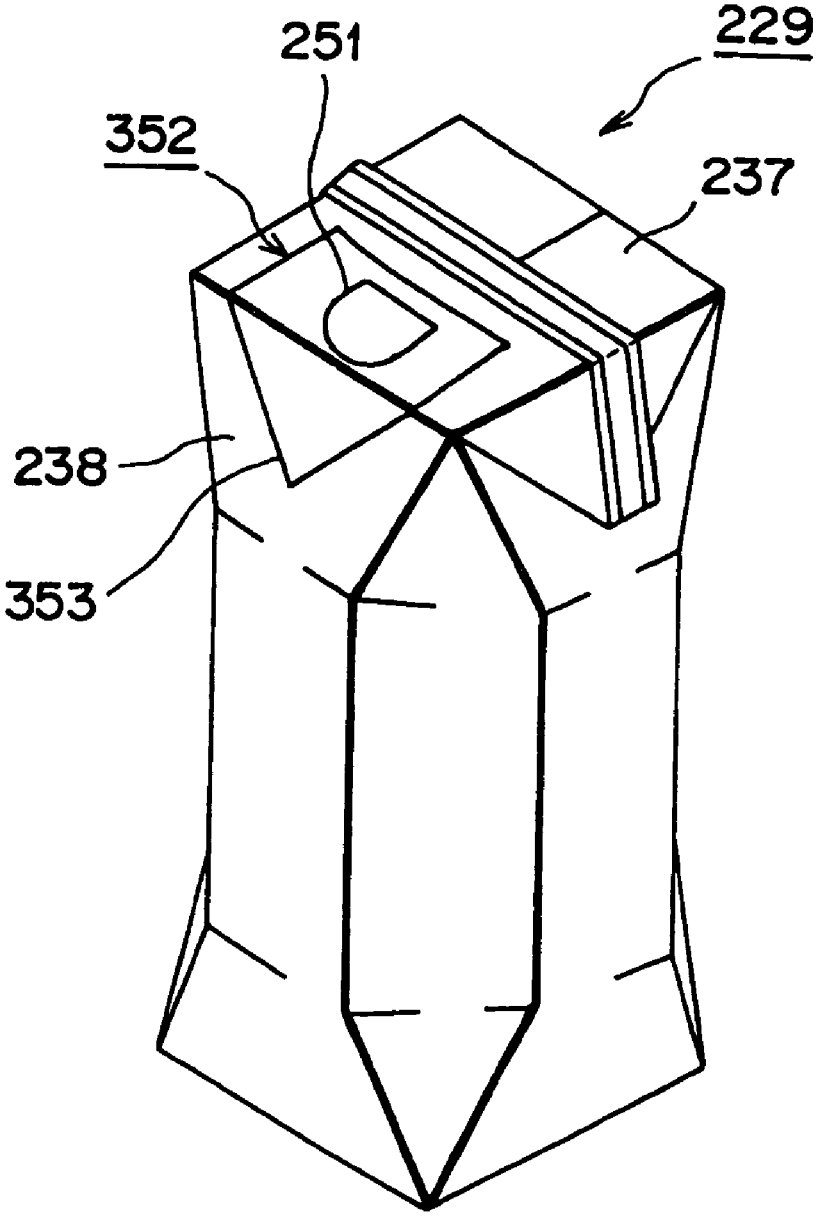
FIG. 35 is a second view showing a state of disposition of an outer patch seal used in the eighth embodiment of the present invention.
Figure 36:
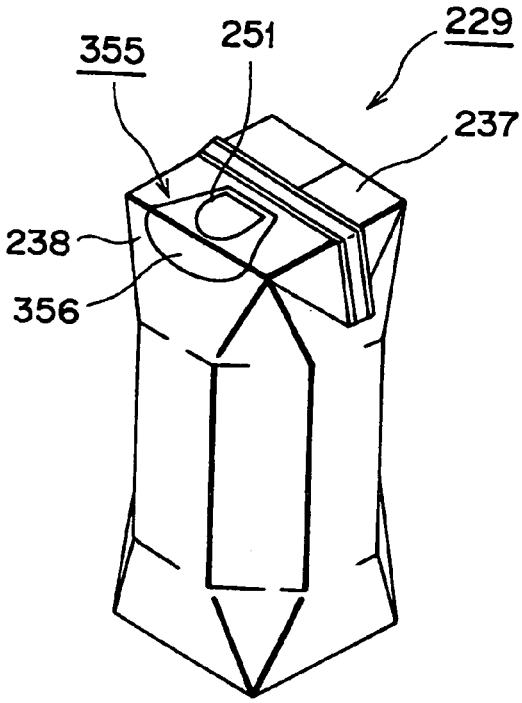
FIG. 36 is a third view showing a state of disposition of an outer patch seal used in the eighth embodiment of the present invention.

FIG. 34 is a first view showing a state of disposition of an outer patch seal used in the eighth embodiment of the present invention; FIG. 35 is a second view showing a state of disposition of an outer patch seal used in the eighth embodiment of the present invention; and FIG. 36 is a third view showing a state of disposition of an outer patch seal used in the eighth embodiment of the present invention.

In a packaging container 229 shown in FIG. 34, the top wall 237 is lowered toward a boundary L2 between the top wall 237 and the front wall 238 and toward the center in the widthwise direction, and an outer patch seal 351 is bonded to the packaging material in the vicinity of a discharge opening 251.

In a packaging container 229 shown in FIG. 35, a skirt portion 353 of an outer patch seal 352 has a triangular shape. In a packaging container 229 shown in FIG. 36, a skirt portion 356 of an outer patch seal 355 has an arcuate shape.

Next, a ninth embodiment of the present invention will be described.

Figure 37:
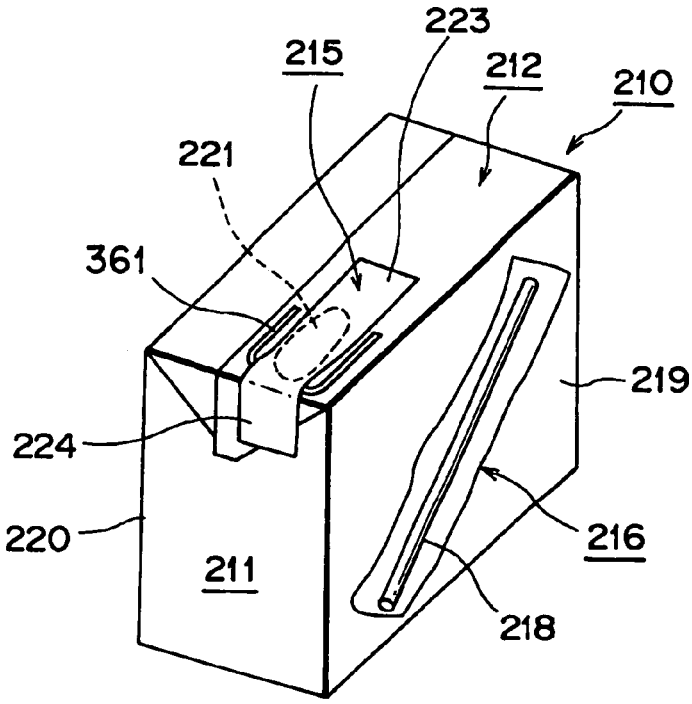
FIG. 37 is a perspective view of a packaging container according to a ninth embodiment of the present invention.

FIG. 37 is a perspective view of a packaging container according to the ninth embodiment of the present invention.

In FIG. 37, reference numeral 210 denotes a container body for accommodating a liquid food, 211 denotes a packaging material; 212 denotes a top wall of the container body 210; 216 denotes a straw package; 218 denotes a straw accommodated in the straw package 216; 219 denotes a rear wall of the container body 210; and 220 denotes a side wall of the container body 210. A discharge opening 221 in the form of a punched hole is formed in a discharge opening portion defined at a predetermined position on the top wall 212, and the discharge opening 221 is covered with a pull tab 215 having a horizontal portion 223 and a vertical portion 224. A U-shaped lip 361 having no lid is fixed onto the top wall 210 such that the lip 361 partially surrounds the discharge opening 221.

The present invention is not limited to the above-described embodiments. Numerous modifications and variations of the present invention are possible in light of the spirit of the present invention, and they are not excluded from the scope of the present invention.

INDUSTRIAL APPLICABILITY

The present invention is applicable to packaging containers for accommodating liquid food and a manufacturing apparatus for manufacturing such packaging containers.

What is claimed is:

1. A method of manufacturing a packaging container from a packaging material comprising:

(a) transporting the packaging material along a packaging material transport path, through a cap attachment station, to a charging station;

(b) transporting a carrier sheet with a plurality of caps thereon to the cap attachment station, to feed caps in succession to the cap attachment station, each of the caps including a collar and a lid;

(c) at the cap attachment station, separating each cap in succession and attaching the separated cap onto a cap attachment portion of the packaging material prior to forming the packaging material;

(d) unseating the lid from the collar to open the cap;

(e) punching a hole in an area of the packaging material surrounded by the collar;

(f) welding an inner tape onto a reverse surface area of the packaging material around the hole and a pull tab onto an outer surface area of the packaging material around the hole in order to cover the hole;

(g) welding together the inner tape and the pull tab in the area of the hole to thereby form a rupture portion;

(h) then forming the packaging material, on which the cap has been attached, into a predetermined shape; and (i) at the charging station, charging a liquid food into the formed packaging material.

2. A method of manufacturing a packaging container according to claim 1, wherein:

the packaging material is in a web-like sheet form before forming; and the packaging material on which the cap has been attached is formed into a tubular shape.

3. A method of manufacturing a packaging material according to claim 1 wherein the carrier sheet is in the form of a tape carrying a single linear array of the caps.

4. A method of manufacturing a packaging container from a packaging material having a thin wall portion preformed therein, said method comprising:

(a) transporting the packaging material along a packaging material transport path, through a cap attachment station, to a charging station;

(b) transporting a carrier sheet with a plurality of caps thereon to the cap attachment station, to feed caps in succession to the cap attachment station, each of the caps including a collar and a lid which is seated on the collar in a closed state;

(c) at the cap attachment station, separating each cap in succession and attaching the separated cap onto the packaging material, with the collar surrounding the thin wall portion, prior to forming the packaging material;

(d) unseating the lid from the collar to open the cap;

(e) welding a pull tab onto an outer surface area of the packaging material in order to cover an area surrounded by the collar;

(f) then forming the packaging material, on which the cap has been attached, into a predetermined shape; and (g) at the charging station, charging a liquid food into the formed packaging material.

5. A method of manufacturing a packaging material according to claim 4 wherein the carrier sheet is in the form of a tape carrying a single linear array of the caps.

* * * * *